United States Patent [19]

Bassotti

[11] 4,283,916

[45] Aug. 18, 1981

[54] THERMAL EXCHANGE SYSTEM AND APPARATUS

[75] Inventor: Armando Bassotti, Caracas, Venezuela

[73] Assignee: Fabrica de Aparatos de Aire Acondicionado, Venezuela

[21] Appl. No.: 68,669

[22] Filed: Aug. 22, 1979

Related U.S. Application Data

[63] Continuation-in-part of Ser. No. 932,601, Aug. 10, 1978, abandoned.

[51] Int. Cl.[3] ..... F25B 9/02

[52] U.S. Cl. ..... 62/5; 62/401

[58] Field of Search ..... 62/5, 86, 401

[56] References Cited

U.S. PATENT DOCUMENTS

| | | | |
|---|---|---|---|
| 2,720,091 | 10/1955 | Schelp | 62/5 |
| 3,208,229 | 9/1965 | Fulton | 62/5 |
| 3,815,375 | 6/1974 | Inglis | 62/5 |

*Primary Examiner*—Ronald C. Capossela

*Attorney, Agent, or Firm*—McGlew and Tuttle

[57] ABSTRACT

A heat exchanger comprising a compressor having an input for receiving air and an output, a static turbulence generator having an input connected to the compressor output, a first output and a second output, an inductor connected to the first output of the static turbulence generator and a control valve connected to the second output of the static turbulence generator. The pressure of air supplied to the static turbulence generator is converted to kinetic energy therein and supplied to the inductor which includes an input for receiving the air with kinetic energy from the static turbulence generator and a second input for receiving additional air with an output and a calibrated duct in the inductor whereby the additional air is drawn into the inductor and heat is absorbed from the surroundings. The control valve is provided for regulating the flow of air to the inductor.

6 Claims, 6 Drawing Figures

THERMAL EXCHANGE SYSTEM AND APPARATUS

CROSS REFERENCE TO RELATED APPLICATIONS

This is a continuation in part application of the inventor's previous application, Ser. No. 932,601 having the same title and filed Aug. 10, 1978, abandoned.

BACKGROUND OF THE INVENTION

1. Field of the Invention

The present invention relates in general to heat exchanger systems and, in particular to a new and useful heat exchanger which utilizes a static turbulence generator to convert the pressure in pressurized medium such as air into kinetic energy thereof and draw heat from the surroundings.

2. Description of the Prior Art

Heat exchangers of many varieties are known such as refrigeration units, air conditioners and the like. Devices such as these are known which utilize compression, absorption, ejection and air cycles to perform the heat exchange function. In devices using compression and absorption which are the most common methods utilized and usually of the closed cycle type, a combination of expensive elements is required such as compressors, evaporators, condensers and the like as well as a cooling liquid or medium of special characteristic such as freon. In an apparatus using an ejection cycle, a vigorous flow of vapor or medium is necessary as are additional components such as evaporators, condensers and a flow of water. Devices utilizing air cycles, are specific to aviation so that they require additional apparatus unique to that field. Such devices are outside the scope and field of the present invention.

SUMMARY OF THE INVENTION

The present invention utilizes the velocity of a cooling medium such as air to produce a cooling or heat exchange function. The structure and elements utilized in the invention are reduced to a minimum both in quantity and volume and high efficiency per unit of power consumed is realized.

Further, the use of mediums such as trichlorofluoromethane and dichlorodifluoromethane compounds (freon 11 and freon 12) in an open cycle arrangement has been avoided and can be selected for a close cycle arrangement. This aspect of the invention is of significance especially in view of the detrimental effects now suspected in connection with such mediums such as for example, the detrimental effect of freon on the ozone layer of the upper atmosphere. This detrimental effect is at least in part due to the leakage of freon and similar mediums from cooling systems and the output from standard aerosol containers.

Accordingly, it is an object of the present invention to provide a heat exchanger with a minimum of components which also avoids the use of dangerous medium and can be run with air from the atmosphere. The unit is thus smaller and more readily portable.

A further object of the present invention is to provide a heat exchanger comprising, a compressor having an input for receiving a pressurized medium such as air and an output, a static turbulence generator having an input connected to the compressor output with a first and second output of its own, the static turbulence generator receiving pressurized medium from the compressor and converting the pressure in the medium into kinetic energy in the medium, an inductor having a first input connected to the static turbulence generator output and a second input for receiving additional medium such as air with an inductor output, the inductor having a calibrated duct therein for inducing a flow of the additional air into the second input whereby heat is absorbed from the surroundings, and a control valve connected to the second output of the static turbulence generator for regulating the flow of medium to the inductor.

A still further object of the present invention is to provide a heat exchanger which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
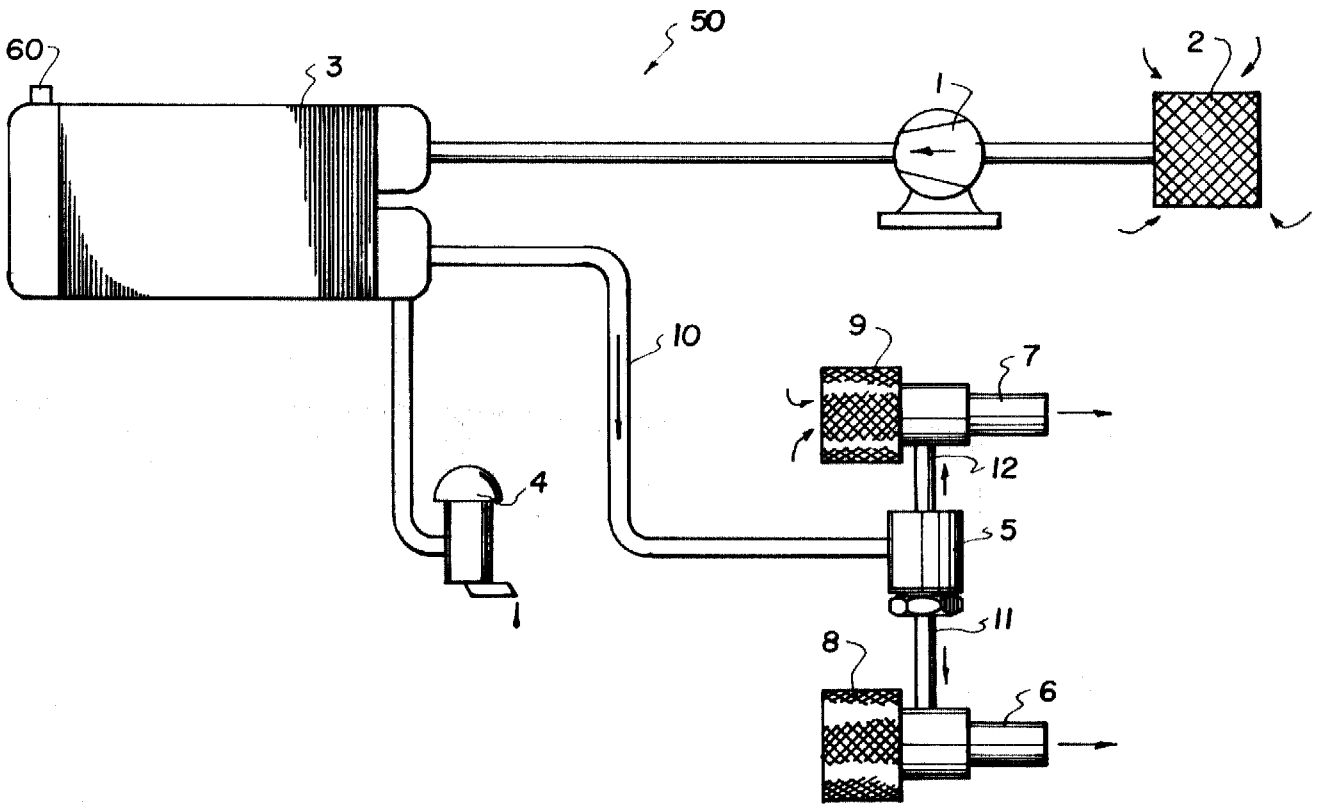
FIG. 1 is a diagramatical view of an overall heat exchanger system in accordance with the invention.
Figure 2:
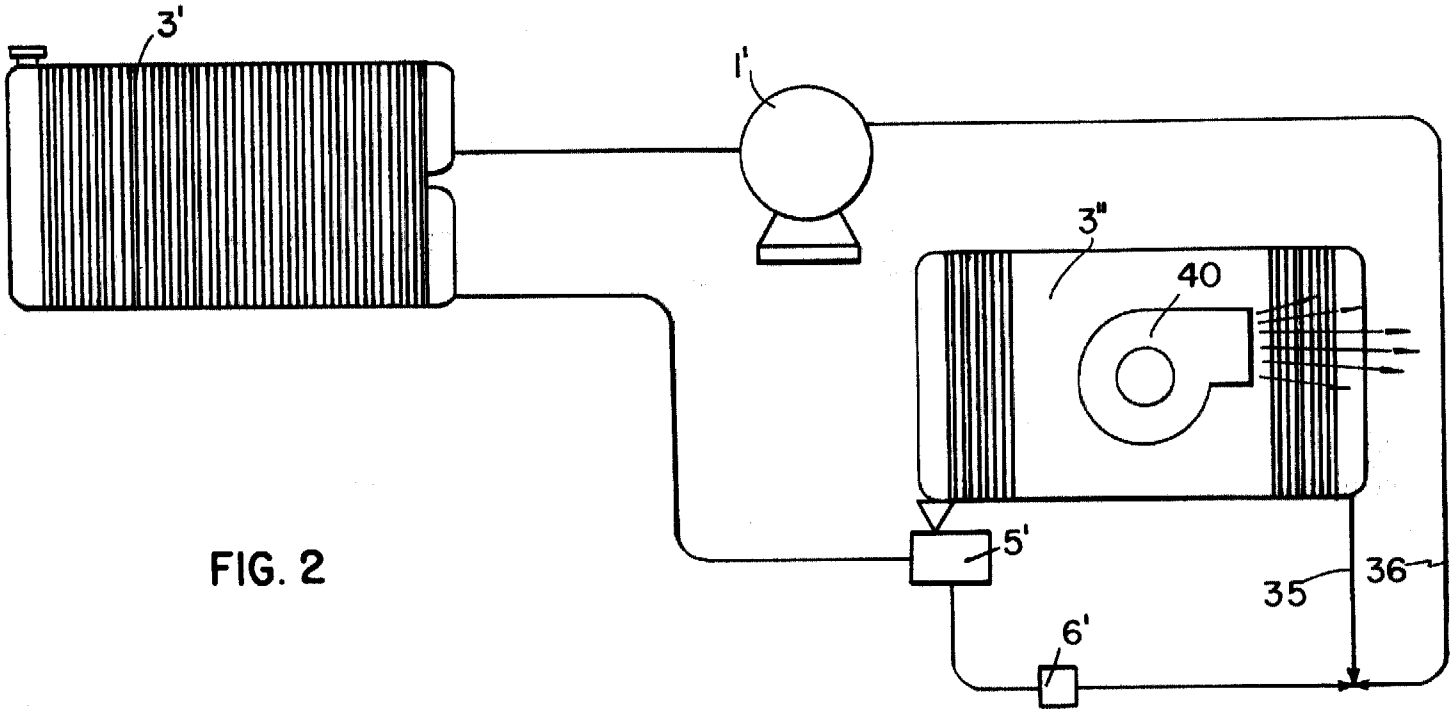
FIG. 2 is a schematic representation of the heat exchanger system in accordance with another embodiment of the invention.

Referring now to the drawings, in particular the invention embodied therein, in FIG. 1 comprises a heat exchanger system generally designated 50 including a pulsating or alternating compressor 1 which draws air from the ambient through a filter 2 and delivers it under pressure to a heat exchanger 3. Heat exchanger 3 includes a high pressure safety valve 60 for relieving overpressure in the heat exchanger and a condensation vapor discharge trap 4 for removing fluid which has condensed out of the pressurized air. It should be understood that a medium other than air can be used when the system is in a different environment or when embodied as a closed circuit unit as shown in FIG. 2 to be described hereinafter.

From heat exchanger 3, the pressurized air flows through a line 10 to a static turbulence generator 5 which includes one inlet at line 10, a first outlet 11 and a second outlet 12. First and second outlets 11 and 12 are connected respectively to throttle valves or flow regulators 6 and 7, one of which acts as an inductor and the other of which acts as a regulating valve. Both flow regulators 6 and 7 include two inlets one at the respective lines 11 and 12 and the other at filters 8 and 9. Both units also include an outlet.

In operation when pressurized air is delivered through line 10 to the static turbulence generator 5, it is divided into two flows which flow in opposite directions through outlet or output lines 11 and 12. In static turbulence generator 5 the flow pressure of the air or medium is converted into flow velocity causing a reduction in temperature due to the reduction in pressure. Once the velocity is increased sufficiently in the static turbulence generator 5, it follows two outlet paths one through a calibrated tube or inductor at 7 which carries part of the medium and the other through the regulating valve 6 producing in the discharge duct a high temperature which in turn provides an increase of volume for the medium or the air and consequently an increase in the entrainment velocity of flow through the calibrated tube which thus absorbs heat from the ambient.

Figure 3:
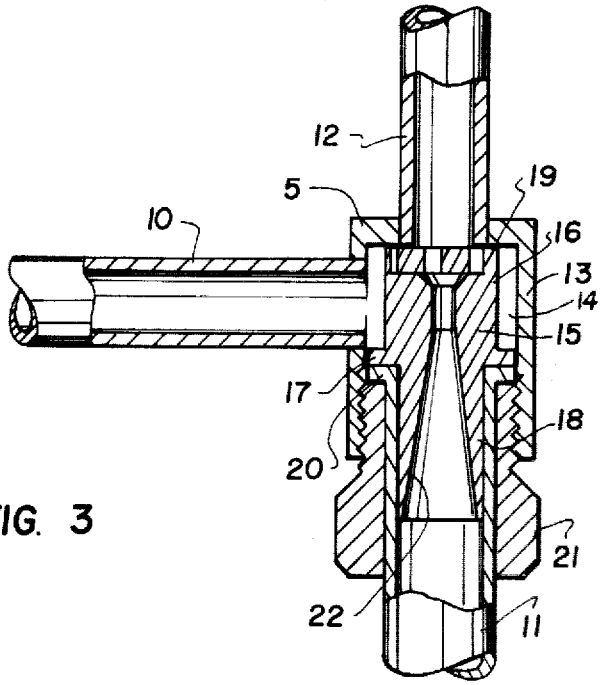
FIG. 3 is a side elevational view in section of the static turbulence generator used in accordance with the invention.
Figure 4:
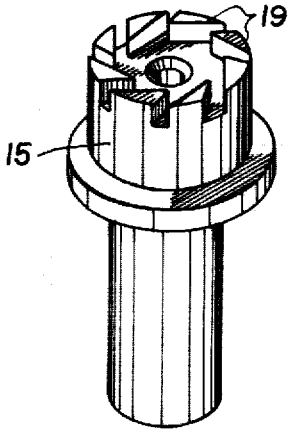
FIG. 4 is a side perspective view of a rotor and passage element utilized in the static turbulence generator of FIG. 3.

Turning to FIG. 3, the static turbulence generator 5 is shown in greater detail. Static turbulence generator 5 includes an input at line 10 and two outputs at lines 12 and 11. The generator is formed by a central drum or cylinder 13 having a cylindrical space 14 therein. A separator 15 is mounted in cylinder 13 and includes a small diameter portion 16, a flange portion 17 and an outlet diffuser portion 18. An annular space is defined between the small diameter portion 16 and the interior of cylinder 13 in space 14. A rotor 19 is formed on one end of the small diameter portion 16 which is best shown in FIG. 4. Fixed rotor 19 comprises a plurality of vanes which channel the air radially inwardly of the annular space 14.

A retaining nut 21 is threaded into one end of the cylinder 13 and bears against a flange 20 of the line 11 thus fixing separator 15 within cylinder 13. Separator 15 includes a diffusor passage 22 which extends from a small diameter opening in the vicinity of the fixed rotor 19 and opens into the line 11.

In operation pressurized medium or air enters through line 10 into annular space 14. Thereafter the air goes through the spaces provided between the vanes of the rotor 19 and is increased in turbulence and diverted into two opposite flows, one through line 12 and the other through line 11. The air entrained through line 11 moves through the diffusor passage 22 and decreases in temperature due to the decrease in pressure induced by the diffusor 22. It should be understood that the number and inclination of the vanes in rotor 19 may be changed to change the characteristics of any particular static turbulence generator 5. It should also be understood that the generator is a rigid structure which has no moving parts.

Figure 5:
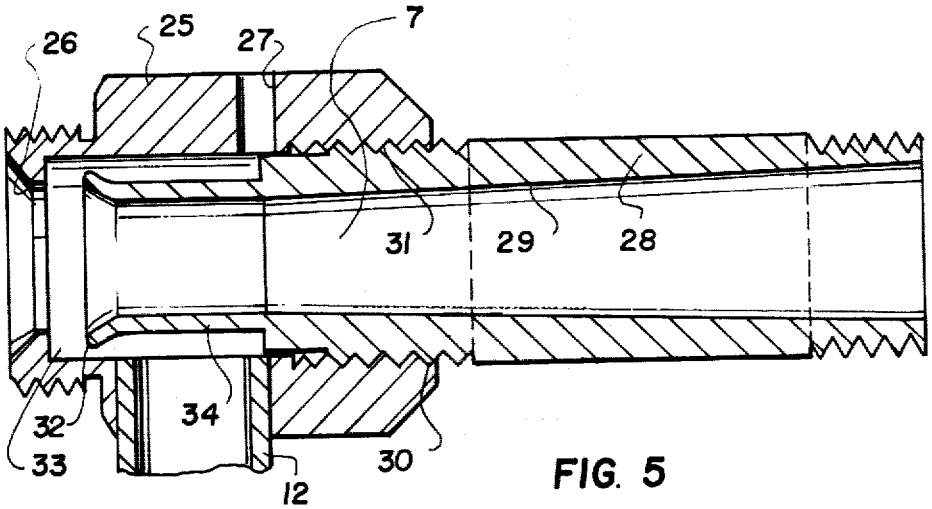
FIG. 5 is a side sectional view of the inductor structure in an open position which structure is the same as that which can be used for the control valve.

The air which is constrained into the passage 22 although cooling at the lower end thereof in FIG. 3, due to the divergence of diffusor 22, is heated at the upper end thereof in the vicinity of line 12. FIG. 5 shows the inductor 7 which acts as such in its open position for cooling. Inductor 7 comprises a cylinder or drum 25 which includes an air or medium inlet opening 26 and an orifice 27. A filter may be mounted over opening 26. The outlet of inductor 7 comprises a cylinder 28 which includes a diverging output opening 29. Cylinder 28 includes threads 30 which are threaded onto internal threads 31 of the drum 25. Cylinder 28 can thus be moved inwardly and outwardly of drum 25 to vary the distance between opening 26 and an upstream end 32 of the cylinder 28. The space between diverging end or mouth 32 and opening 26 comprises an annular calibrated duct 33.

Air or medium under pressure enters inductor 7 through the outlet line 12 of the static turbulence generator 5 and into the annular space defined between a small diameter portion 34 of cylinder 28 and the interior of drum or cylinder 25. The air then rushes around the mouth 32 of cylinder 28 and through the calibrated duct. The size of the calibrated duct of course can be varied by screwing cylinder 28 to a greater or a lesser extent into the drum 25. High velocity air thus rushing around mouth 32 induces ambient outside air to enter through air inlet 26. Orifice 27 in this connection induces a mixture of the outside air with the high velocity air. The mixture thereafter proceeds through the diverging output passage 29. A cooling of the outside air is thus achieved through an induction and reduction in pressure of the outside air-high velocity air mixture.

Figure 6:
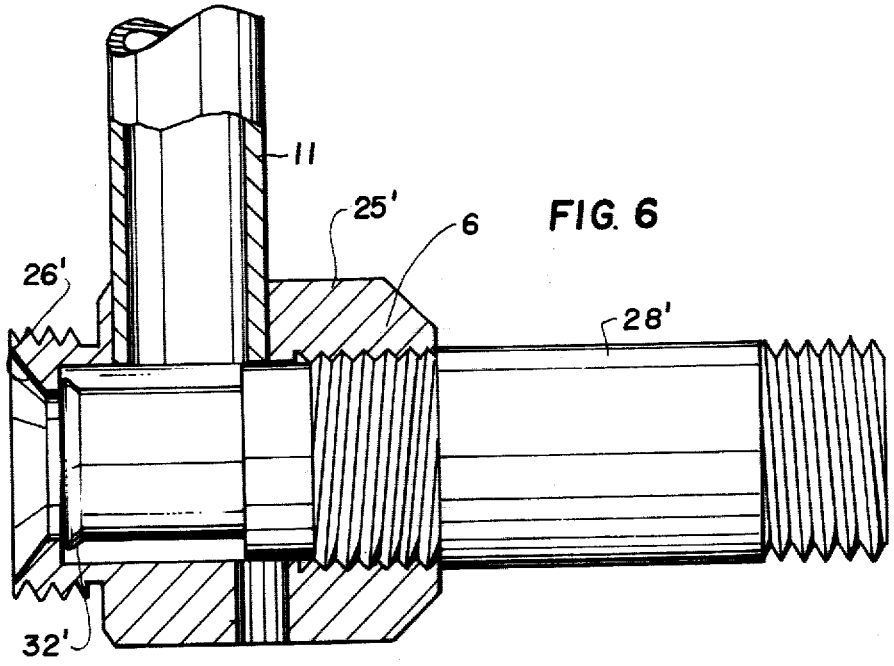
FIG. 6 is a view of a control valve, which is the same structure that can be used as the inductor of FIG. 5 but shown in closed position.

FIG. 6 shows the throttle valve 6 which, in this embodiment comprises a regulating valve for regulating the flow of air to the inductor 7. It is the same in structure as inductor 7, but it is closed. In the figure, the cylinder 28' is threaded into the drum 25' to such an extent that the air inlet 26' is closed off by the mouth 32'.

Turning now to FIG. 2, a closed circuit variety for the heat exchanger system is shown. In this embodiment, a compresser 1' supplies pressurized medium into a heat exchanger 3'. Medium under pressure is then supplied to the static turbulence generator 5 and divided into two flows one flowing into a second heat exchanger 3'' and the other flowing into a regulating valve 6'. Downstream of valve 6' the flow is divided into a line 35 and a line 36. Line 35 conducts the medium back to the second heat exchanger 3'' and line 35 diverts the medium back to the compressor 1'. A fan 40 may be provided for moving air past the second heat exchanger 3'' to produce a cooling effect.

While specific embodiments of the invention have been shown and described in detail to illustrate the application of the principles of the invention, it will be understood that the invention may be embodied otherwise without departing from such principles.

What is claimed is:

1. A heat exchanger system comprising, a compressor having an input for receiving a pressurizable medium and an output, a static turbulence generator having an input connected to said compressor output, a first output for warmed medium and a second output for cooled medium, said static turbulence generator receiving pressurized medium from said compressor and converting the pressure thereof into kinetic energy in the medium in the form of increased velocity thereof in said first output, an inductor having a first input connected to said first static turbulence generator output, a second input for receiving additional pressurizable medium and an output with a calibrated duct in said inductor for inducing additional medium into said second input and out of said inductor through said inductor output, and a control valve connected to said second static turbulence generator output for regulating the flow of medium to said inductor, said inductor comprises a drum member, means in said drum member defining said calibrated duct between said first inductor input and said second inductor input whereby the additional medium is mixed with the medium for said first input and means downstream of said calibrated duct defining a diverging duct, said calibrated duct having an annular chamber communicating with said first static turbulence generator output and said drum mouth end in said calibrated duct upstream of said diverging duct.

2. A heat exchanger according to claim 1 further including a heat exchanger connected between said compressor output and said static turbulence generator input.

3. A heat exchanger system according to claim 1 wherein said static turbulence generator comprises a drum, a separator in said drum having at least a portion defining a space therebetween, said separator defining a diffusor conduit increasing diameter from said static turbulence generator input to said second output of said static turbulence generator, and a fixed rotor on said separator upstream of said diffusor.

4. A heat exchanger system according to claim 1 wherein said drum member includes an air mixture orifice communicating with said calibrated duct.

5. A heat exchanger system according to claim 1 wherein said inductor comprises a second heat exchanger having an input connected to said first static turbulence generator output and an output connected to said compressor input.

6. A heat exchanger system according to claim 5 wherein said control valve includes an input connected to said second output of said static turbulence generator and an output connected to said second heat exchanger output.

* * * * *